US007911419B2

(12) United States Patent
Hashimoto et al.

(10) Patent No.: US 7,911,419 B2
(45) Date of Patent: Mar. 22, 2011

(54) PLASMA DISPLAY PANEL DRIVING METHOD AND PLASMA DISPLAY APPARATUS

(75) Inventors: Yasunobu Hashimoto, Kawasaki (JP); Tomokatsu Kishi, Yamato (JP); Tetsuya Sakamoto, Kawasaki (JP); Naoki Itokawa, Kawasaki (JP); Takayuki Kobayashi, Machida (JP); Yoshimi Kawanami, Miyazaki (JP); Osamu Toyoda, Kunitomicho (JP); Yasuhiko Kunii, Kunitomicho (JP); Takahiro Takamori, Yonago (JP); Kunio Takayama, Kashima (JP)

(73) Assignee: Fujitsu Hitachi Plasma Display Limited, Kanagawa (JP)

( * ) Notice: Subject to any disclaimer, the term of this patent is extended or adjusted under 35 U.S.C. 154(b) by 1035 days.

(21) Appl. No.: 11/317,006

(22) Filed: Dec. 27, 2005

(65) Prior Publication Data

US 2006/0158390 A1 Jul. 20, 2006

(30) Foreign Application Priority Data

Dec. 27, 2004 (JP) ..... 2004-377477

(51) Int. Cl.
*G09G 3/28* (2006.01)

(52) U.S. Cl. ..... 345/67; 345/30; 345/68

(58) Field of Classification Search ..... 345/30, 345/37, 55–72, 210–214; 315/169.1–169.4
See application file for complete search history.

(56) References Cited

U.S. PATENT DOCUMENTS

| | | | | |
|---|---|---|---|---|
| 6,414,656 | B1 * | 7/2002 | Hong | 345/60 |
| 6,483,491 | B1 | 11/2002 | Lee | |
| 2002/0047578 | A1 * | 4/2002 | Kishi et al. | 315/169.3 |
| 2003/0090443 | A1 * | 5/2003 | Kobayashi | 345/60 |
| 2004/0169621 | A9 * | 9/2004 | Lee et al. | 345/60 |

FOREIGN PATENT DOCUMENTS

| | | | |
|---|---|---|---|
| CN | 1204831 | A | 1/1999 |
| CN | 1269570 | A | 10/2000 |
| JP | 2000-251746 | | 9/2000 |
| JP | 2002-134033 | | 5/2002 |
| JP | 2002-352726 | | 12/2002 |
| JP | 2003-241708 | | 8/2003 |
| JP | 2004-191610 | | 7/2004 |
| KR | 2000-059281 | | 10/2000 |

* cited by examiner

*Primary Examiner* — Alexander Eisen
*Assistant Examiner* — Christopher E Leiby
(74) *Attorney, Agent, or Firm* — Antonelli, Terry, Stout & Kraus, LLP.

(57) ABSTRACT

In a conventional method of driving a plasma display panel, for example, an auxiliary discharge is executed between an A electrode and a Y electrode to improve light-emission efficiency of a display discharge. However, since a phosphor layer is present between the A electrode and the Y electrode, the phosphor layer is exposed to a discharge, whereby there is a problem that its characteristic deteriorates. A method of driving a plasma display panel having a structure, in which at least three display electrodes X, Y, and Z used for a display discharge are provided to a display cell and no phosphor layer is formed between said display electrodes and a discharge space, the method comprising the steps of: varying a potential of at least one display electrode Z of said display electrodes during said display discharge; and making a potential of said at least one display electrode Z at a time of starting said display discharge different from that at a time of ending said display discharge.

3 Claims, 15 Drawing Sheets

VARY ELECTRODE POTENTIAL DURING DISCHARGE

Sg = 250 μm

Tg = 75 μm

Tw = 100 μm ( DISPLAY LOAD RATIO : LARGE )

( DISPLAY LOAD RATIO : SMALL )

( DISPLAY LOAD RATIO : SMALL )

PLASMA DISPLAY PANEL DRIVING METHOD AND PLASMA DISPLAY APPARATUS

CROSS-REFERENCE TO RELATED APPLICATION

The present application claims priority from Japanese patent application No. JP 2004-377477 filed on Dec. 27, 2004, the content of which is hereby incorporated by reference into this application.

BACKGROUND OF THE INVENTION

The present invention relates to a driving method for a plasma display panel (PDP) and a plasma display apparatus.

In recent years, an AC plasma display apparatus for executing a surface discharge has been commercially available as a flat-type display apparatus, and has been used as a display apparatus for personal computer and work station, etc., a flat-type wall-mounted television, and an apparatus for displaying advertisements, information, and others. Such a plasma display apparatus for executing the surface discharge has a structure in which a pair of electrodes is formed on an inner surface of a front glass substrate and an inert gas is enclosed therein, so that when a voltage is applied between these electrodes, the surface discharges occur on surfaces of a dielectric layer and a protective layer formed on an electrode surface and ultraviolet radiation is generated. On an inner surface of a rear glass substrate, phosphors of three primary colors, red (R), green (G), and blue (B), are applied. By exciting and light emitting these phosphors by ultraviolet radiation, color display is achieved.

FIG. 1 is a block diagram schematically showing an example of a conventional plasma display apparatus and shows an AC driven plasma display apparatus for three-electrode surface discharge. Note that the plasma display apparatus shown in FIG. 1 is merely an example and the present invention described below can be applied to display apparatuses for executing display discharges (sustain discharges), which have various structures other than a structure of the AC driven plasma display apparatus for three-electrode surface discharge shown in FIG. 1.

A plasma display apparatus 100 includes: a PDP 1; an X driver 75, a Y driver 77, and an A driver (address driver) 79 for driving each display cell (discharge cell) 10 of the PDP 1; a control circuit (control block) 71 for controlling these drivers; and a power supply circuit 73.

The PDP 1 is, for example, such that a plurality of pixels having phosphors of R, G, and B are arranged and color display is achieved by exiting and light emitting the phosphors of the respective cells 10 by ultraviolet radiation. The PDP 1 includes X electrodes and Y electrodes provided in a row direction and A (address) electrodes provided in a column direction. These X electrodes, Y electrodes, and A electrodes are controlled by a driver controller 730 and are also driven by the X driver 75, the Y driver 77, and the A driver 79, respectively, connected to the power supply circuit 73.

The control block 71 includes a data conversion circuit 710, a frame memory 720, a driver controller 730, an APC (Auto Power Control) computation circuit 740, and a number-of-pulses table 750. Frame data Df representing luminance levels (input luminance levels) of three colors of R, G, and B from an external device such as a TV tuner or computer, and an unshown dot clock CLK as well as various synchronization signals (a horizontal synchronization signal Hsync, a vertical synchronization signal Vsync, and others) are inputted in the control block 71. Note that a frame and a sub-frame are also called a field and a subfield, respectively.

The data conversion circuit 710 converts the frame data Df serving as multivalued image data into sub-frame data Dsf for reproducing gray scale through a combination of binary images. The sub-frame data Dsf is stored in a frame memory 720, and is then transferred to the A driver 79 by the driver controller 730 in accordance with progress of the display and is used for an addressing which makes a charge amount of the cell 10 corresponding to whether the light emission is required.

The APC computation circuit 740 and the number-of-pulses table 750 are components for the APC. The APC computation circuit 740 obtains a display load from the sub-frame data Dsf to define a setting luminance L' for the maximum level gray scale. The setting luminance L' represents control information for specifying the number of times of display discharge of the cell that displays the maximum level gray scale.

An allocation of a light emission amount to a plurality of sub-frames (SF) forming one frame (F) is stored in the number-of-pulses table 750, and a display pulse number f for each sub-frame corresponding to the setting luminance L' is notified of the driver controller 730. In response to this, for display of each sub-frame, the driver controller 730 makes the display discharge being executed up to times equal to the display pulse number f corresponding to the sub-frame. When the setting luminance L' in the APC computation circuit 740 is determined, a corresponding relation between each level of the gray scale to be displayed and the luminance of the cell, that is, a total number of display pulses to be applied to the cells in one frame for reproducing each level of the gray scale is uniquely defined.

FIG. 2 is a view for explaining a driving sequence in the plasma display apparatus shown in FIG. 1.

In order to make a color display through binary On-state control in driving the PDP 1 of the plasma display apparatus 100, a frame F inputted per predetermined interval is divided into n sub-frames SF1 to SFn. In this case, the sub-frames SF1 to SFn have weights W1 to Wn, respectively and, in accordance with the weight, the number of times of display discharge is determined. Note that the weights W1 to Wn may be determined so as to satisfy powers of two (1, 2, 4, 6, 8, 16, . . . ), but in order to suppress an occurrence of a dynamic false contour associated with the gray-scale display of frame division, various settings can be made, such as a setting in which a plurality of sub-frames having the same weight are included.

To match such a frame structure, a frame period Tf, which is a frame transfer period, is divided into n sub-frame periods Tsf, and one sub-frame period Tsf is assigned to each sub-frame SF. Furthermore, each sub-frame period Tsf is divided into a reset period TR for initializing a wall charge, an address period TA for addressing, and a display period (sustain discharge period) Ts for sustaining an On state. In this case, the length of the reset period TR and the length of the address period TA are constant irrespectively of the weight of the sub-frame SF, whilst the length of the display period TS is longer since the number of times of discharge is increased as the weight of the sub-frame SF is larger.

FIG. 3 is a view schematically showing driving waveforms of the plasma display apparatus shown in FIG. 1. In FIG. 3, suffixes 1 to v attached to the Y electrodes (Y1 to Yv) represent the arrangement order. Note that the driving waveforms shown in FIG. 3 are merely an example, and their amplitudes, polarities, and timing, etc. can vary.

In the reset period TR of each sub-frame SF, ramp waveform pulses of positive and negative polarities are sequentially applied to all of the X electrodes. Also, ramp waveform pulses of positive and negative polarities are sequentially applied to all of the Y electrodes (Y1 to Yv). Note that applying the pulse to the electrode means temporarily biasing of the electrode.

In this case, a combined voltage obtained by totalizing amplitudes of pulses given to the X electrode and the Y electrodes is applied to the cell 10. A micro discharge occurring at a first pulse application makes the wall voltages with the same polarity being generated to all of the cells 10, irrespectively of On/OFF state of the previous sub-frame. Also, a micro discharge occurring at a second pulse application adjusts the wall voltage to a value equivalent to a difference in amplitude between a firing voltage and an applied voltage.

In the address period TA, wall charges required for sustaining the On state are formed only for any cells to be turned On. In a state in which all the X electrodes and all the Y electrodes are biased to predetermined potentials, for every row selection period (scan time for one row), a scan pulse Py is applied to one Y electrode corresponding to the selected row. Simultaneously with this row selection, an address pulse Pa is applied to only an A electrode corresponding to the selected cell that has to generate an address discharge. That is, based on the sub-frame data Dsf of the selected row, the potential of the A electrode is subjected to binary control. For this reason, in the selected cell, a discharge occurs between the Y electrode and the A electrode. Such an occurrence becomes a trigger, which results in an occurrence of a discharge between the X electrode and the Y electrode. A series of these discharges forms an address discharge.

In the display period TS, a display pulse (also called a sustain pulse) Ps is applied alternately to the Y electrode and the X electrode. Therefore, a pulse string whose polarity is alternately changed is applied to the cell. Since this display pulse Ps is applied, the display discharge occurs at the cell in which a predetermined wall charge remains. The number of times of application to the display pulse Ps corresponds to the weight of the sub-frame, and is adjusted in accordance with the display load.

FIG. 4 is a view schematically showing an electrode structure of one cell of one example of the conventional plasma display apparatus. In FIG. 4, the reference numeral "11" denotes a front-side substrate, "12" denotes an X electrode (transparent electrode and bus electrode for X electrode), "13" denotes a Y electrode (transparent electrode and bus electrode for Y electrode), "14" and "17" denote dielectric layers, "15" denotes a rear-side substrate, "16" denotes an address electrode (transparent electrode and bus electrode for A electrode), and "18" denotes a phosphor layer.

As shown in FIG. 4, the X electrode 12 and the Y electrode 13 are provided in parallel on the front-side substrate 11, and further the dielectric layer 14 is formed so as to cover the X electrode 12 and the Y electrode 13. The A electrode 16 is provided on the rear-side substrate 15 in a direction perpendicular to the X electrode 12 and the Y electrode 13 of the opposite front-side substrate 11, and further the dielectric layer 17 and the phosphor layer 18 are formed so as to cover the A electrode 16.

In a spacing 19 between the front-side substrate 11 provided with the X electrode 12 and the Y electrode 13 and the rear-side substrate 15 provided with the A electrode 16, a discharge gas such as a mixture of gases of neon and xenon is charged. A discharge space, which is a crossing portion between the X and Y electrodes 12 and 13 and the A electrode 16, forms one cell 10.

Conventionally, in order to reduce the firing voltage for executing the display discharge, there has been proposed a plasma display apparatus in which a thin auxiliary electrode is provided between the X electrode and the Y electrode and an auxiliary-electrode driving pulse is applied to this auxiliary electrode at a time not later than a time of starting a discharge sustain pulse (display discharge pulse) for driving (for example, see Patent Document 1: Japanese Patent Laid-Open Publication No. 2000-251746). Also, conventionally, there has been proposed a PDP in which a dummy electrode is provided between two sustain electrodes (display electrodes: X electrode and Y electrode) aligned in parallel and, by applying a potential between the potentials of the scan electrode and the sustain electrodes, a crosstalk at a time of writing is reduced (for example, see Patent Document 2: Japanese Patent Laid-Open Publication No. 2002-134033 and Patent Document 3: Japanese Patent Laid-Open Publication No. 2002-352726).

Furthermore, conventionally, a plasma display driving method (for example, see Patent Document 4: Japanese Patent Laid-Open Publication No. 2003-241708) has been proposed as follows. That is, in order to improve luminance and light-emitting efficiency at the display discharge, An addressing for forming the wall charge to the cell to be turned ON is carried out. Thereafter, in order that the cell makes the display discharge and reformation of the wall charge subsequently to it being carried out, the potential of at least one display electrode is varied so that the potential at the time of starting the display discharge is different from that at the time of ending the display discharge and, concurrently, the potential of at least one electrode other than the display electrode is varied so that the potential at the time of starting the display discharge is different from that at the time of ending the display discharge.

Still further, conventionally, a display device driving method and an image display apparatus have been proposed (for example, see Patent Document 5: Japanese Patent Laid-Open Publication No. 2004-191610) as follows. That is, in order to reduce an unnatural change in brightness occurring when the display load is changed and to achieve stable power control without a sporadic increase in power consumption, when the change in the display load is mild, the light emission amount is slightly changed and the following of the power control with respect to the change in the display load at that time is made slow. Conversely, when the change in the display load is sharp, the light emission amount is significantly changed and the following of the power control at that time is made quick.

Note that conventionally an AC driven PDP has been also proposed (for example, see Non-patent Document 1: "Highly Luminance-efficient AC-PAP with Delta Cell Structure Using New Sustain Waveforms", SID 03 DIGEST pp. 137-139, issued on May, 2003).

SUMMARY OF THE INVENTION

FIG. 5 is a view schematically showing driving waveforms of a display discharge in one example of the conventional plasma display apparatus, and shows a disclosure in the above-mentioned Patent Document 4.

As shown in FIG. 5, in order to improve luminance and light-emitting efficiency at the display discharge (sustain discharge) in one example of the conventional plasma display apparatus, when the display discharge (main discharge) is executed between the X electrode and the Y electrode, a short pulse voltage in synchronization with pulses applied to the X electrode and the Y electrode is applied to the A electrode, which results in an occurrence of an auxiliary discharge (d1) serving as a trigger of the main discharge (d2). Note that the structure of the cell 10 is as shown in FIG. 4 described above, for example.

That is, as shown in FIGS. 4 and 5, in the conventional plasma display driving method, the short pulse voltage is given to the A electrode and the auxiliary discharges (micro discharges: d1) are generated between the A electrode 16 and the Y electrode 13 and between the A electrode 16 and the X electrode 12, whereby the luminance and the light-emitting efficiency in the main discharge (display discharge: d2) between the X electrode 12 and the Y electrode 13 have been improved.

However, in this conventional plasma display driving method, the phosphor layers 18 are present between the A electrode 16 and the Y electrode 13 and between the A electrode 16 and the X electrode 12, and moreover the number of times of the display discharge is extremely many (for example, approximately several thousands per frame). Therefore, there is a problem that the phosphor layer 18 is exposed to the discharge and its characteristic deteriorates (reduction in life of the phosphor material).

Note that an address discharge is executed between the A electrode 16 and the Y electrode 13 during the address period TA and, also in this case, the phosphor layer 18 is exposed to the discharge. However, the number of times of the discharge required is about ten per frame (once for each sub-frame), which substantively results in no influence on the life of the phosphor material.

In consideration of the above-described problems of the plasma display panel driving method and the plasma display apparatus, an object of the present invention is to improve the luminance and the light-emission efficiency in the display discharge and suppress the characteristic deterioration of the phosphor layer.

According to a first phase of the present invention, a method of driving a plasma display panel having a structure, in which at least three display electrodes used for a display discharge are provided to a display cell and no phosphor layer is formed between said display electrodes and a discharge space, comprises the steps of: varying a potential of at least one display electrode of said display electrodes during said display discharge; and making a potential of said at least one display electrode at a time of starting said display discharge different from that at a time of ending said display discharge.

According to a second phase of the present invention, a plasma display apparatus comprising: a plasma display panel having a plurality of X electrodes, a plurality of Y electrodes disposed approximately in parallel with said plurality of X electrodes and discharged between the plurality of Y electrodes and said plurality of X electrodes, and a plurality of Z electrodes each provided between each of said X electrodes and each of said Y electrodes; a driver for driving said plasma display panel; and a control circuit for receiving an image signal, converting the image signal to image data suitable for said plasma display panel and for driving said plasma display panel through said driver, wherein a cell is formed by said X electrode, said Y electrode, and a central Z electrode located between said X electrode and said Y electrode, a potential of said central Z electrode is varied during a display discharge so that the potential of said central Z electrode at a time of starting said display discharge is made different from that at a time of ending said display discharge.

According to the present invention, the luminance and the light-emission efficiency in the display discharge can be improved and the characteristic deterioration of the phosphor layer can be suppressed.

DESCRIPTION OF THE PREFERRED EMBODIMENTS

With reference to the accompanying drawings, embodiments of a plasma display panel driving method and a plasma display apparatus according to the present invention will be described in detail below.

Figure 6:
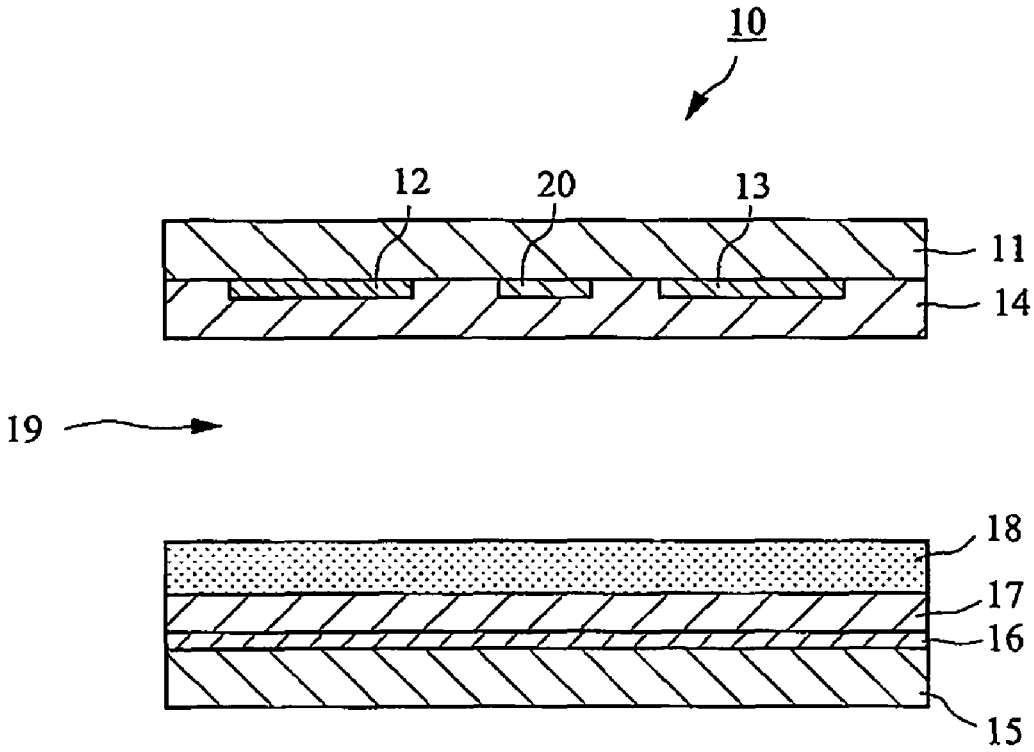
FIG. 6 is a view schematically showing an electrode structure of one cell of a plasma display apparatus according to one embodiment of the present invention.
Figure 7:
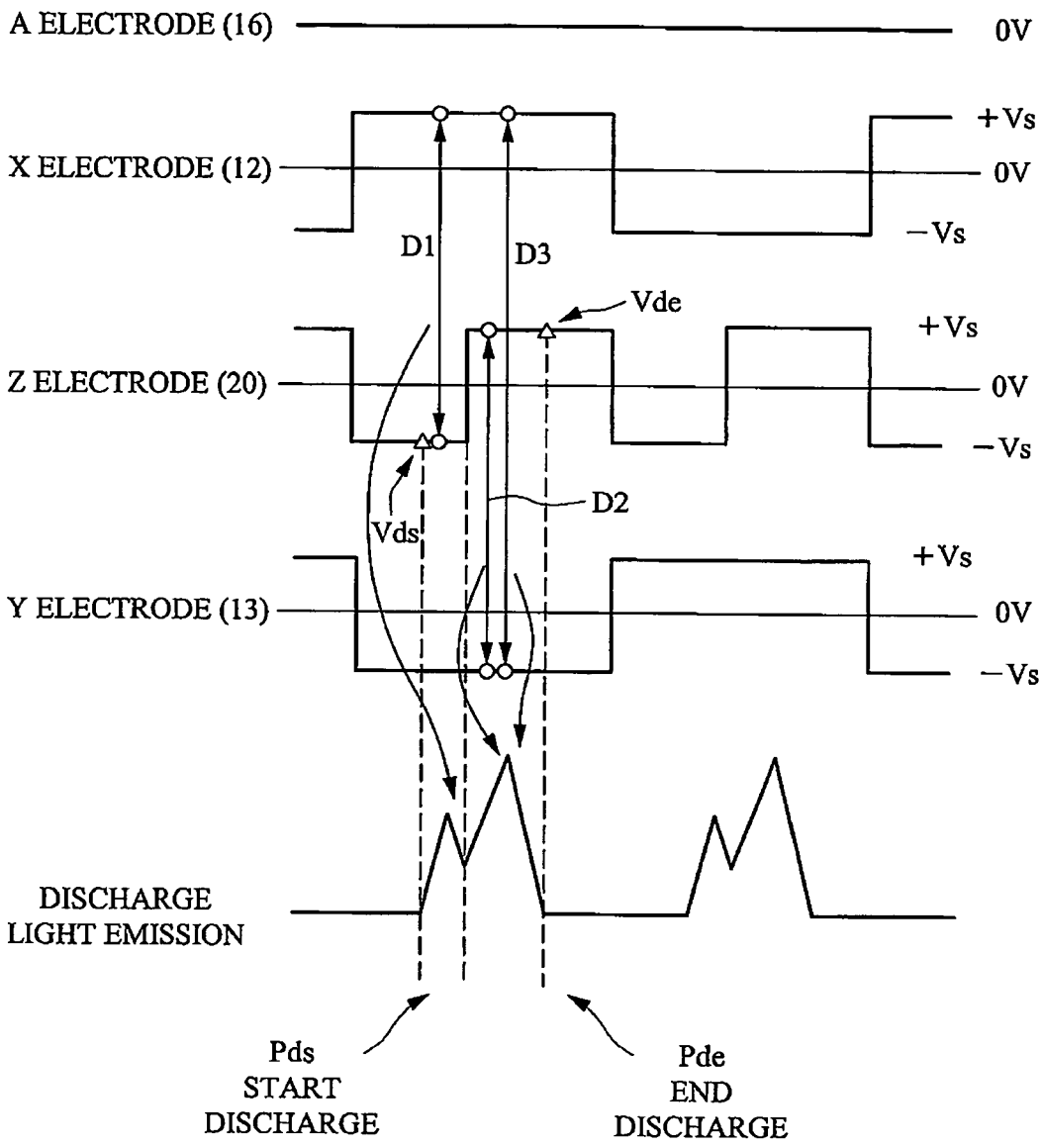
FIG. 7 is a view schematically showing driving waveforms of a display discharge in the plasma display apparatus according to one embodiment of the present invention.

FIG. 6 is a view schematically showing an electrode structure of one cell of a plasma display apparatus according to one embodiment of the present invention. FIG. 7 is a view schematically showing driving waveforms of a display discharge in the plasma display apparatus according to one embodiment of the present invention.

Figure 1:
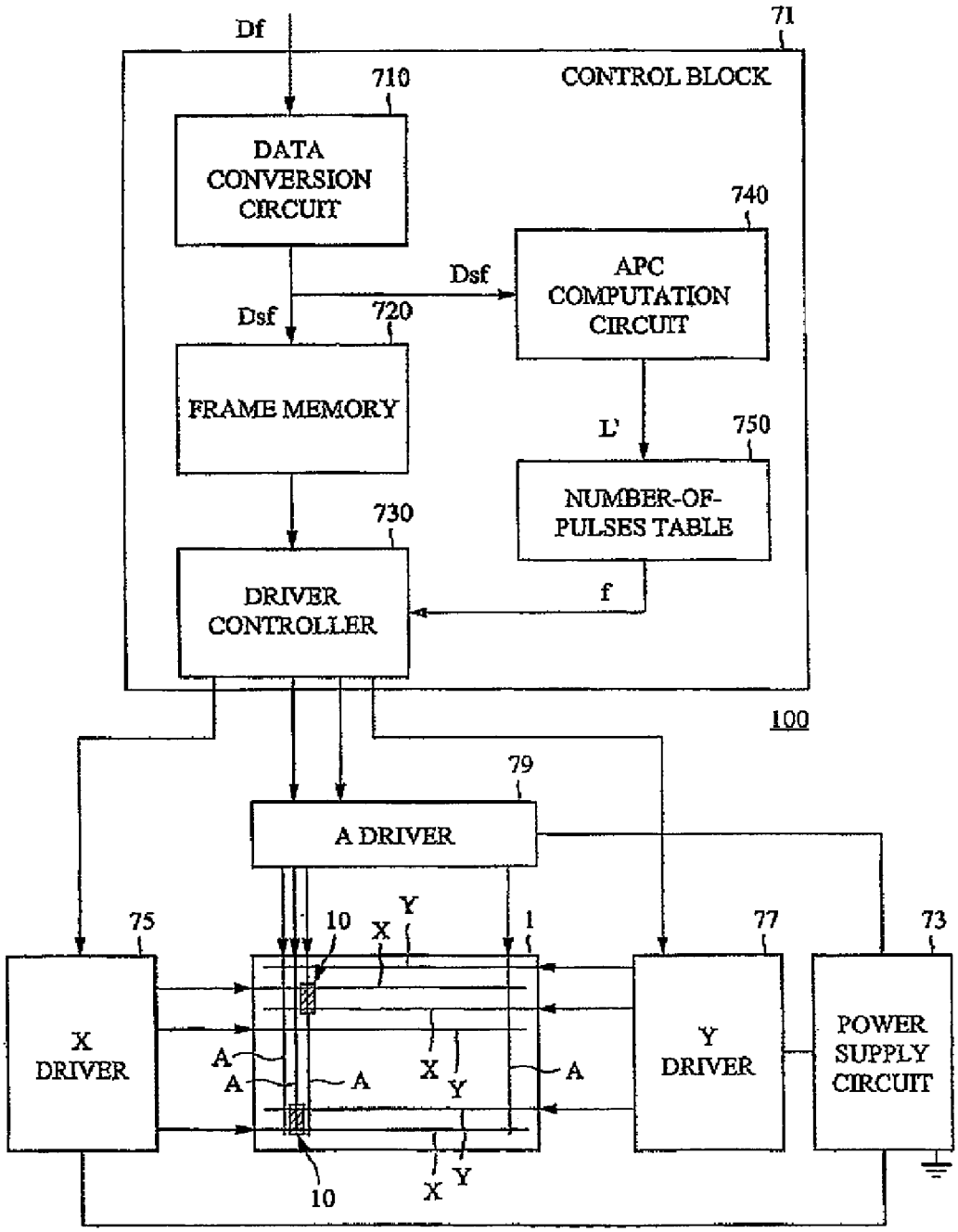
(Prior Art) FIG. 1
FIG. 1 is a block diagram schematically showing an example of a conventional plasma display apparatus.
Figure 2:
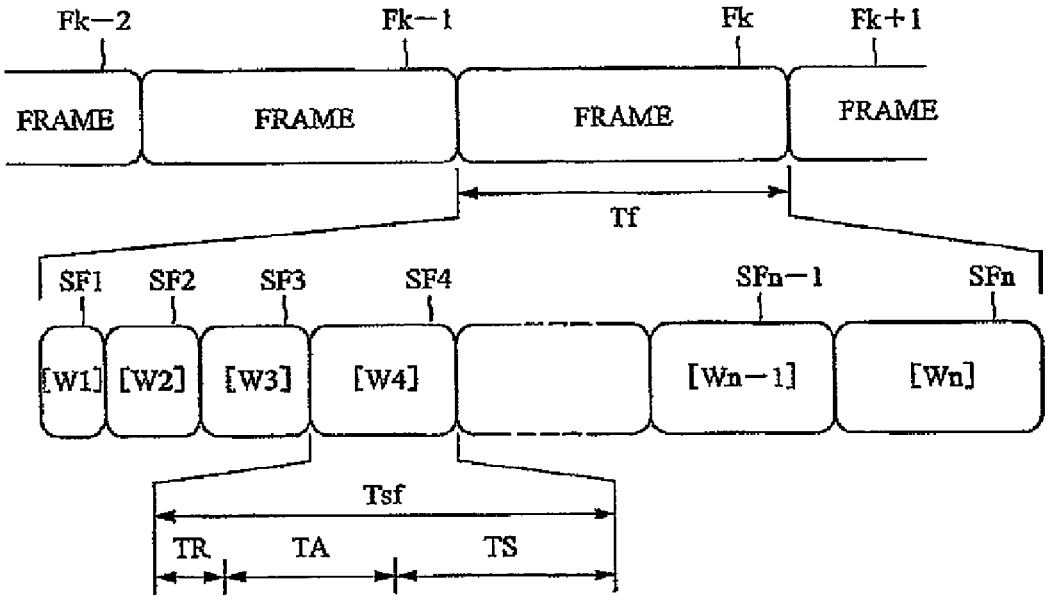
(Prior Art) FIG. 2
FIG. 2 is a view for explaining a driving sequence in the plasma display apparatus shown in FIG. 1.
Figure 3:
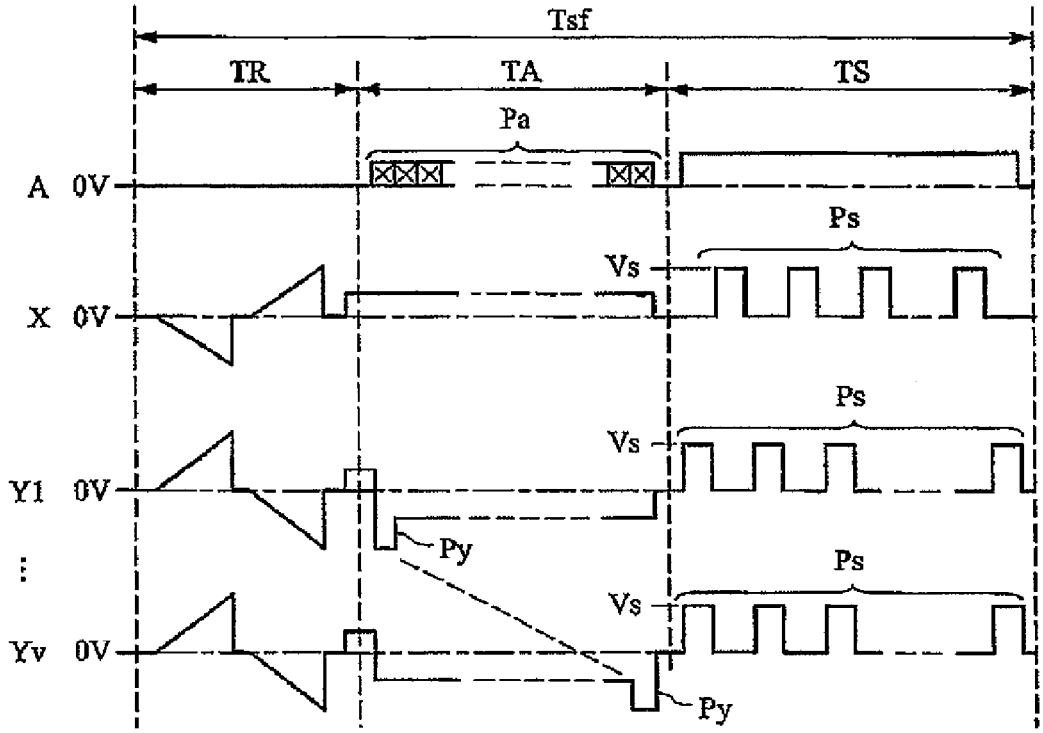
(Prior Art) FIG. 3
FIG. 3 is a view schematically showing driving waveforms in the plasma display apparatus shown in FIG. 1.
Figure 4:
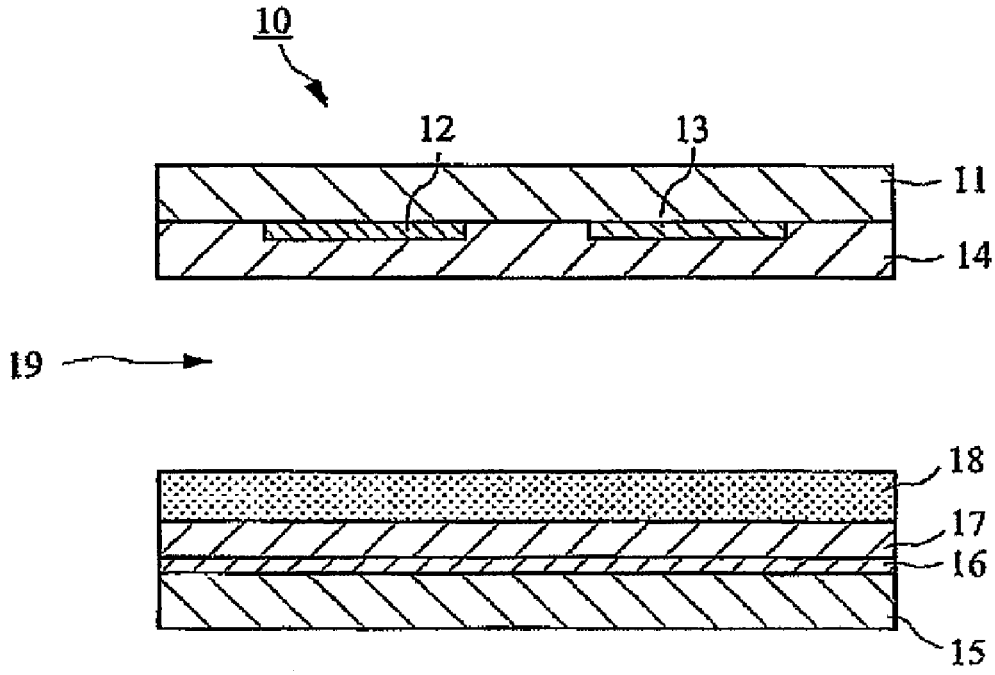
(Prior Art) FIG. 4
FIG. 4 is a view schematically showing an electrode structure of one cell in one example of the conventional plasma display apparatus.
Figure 5:
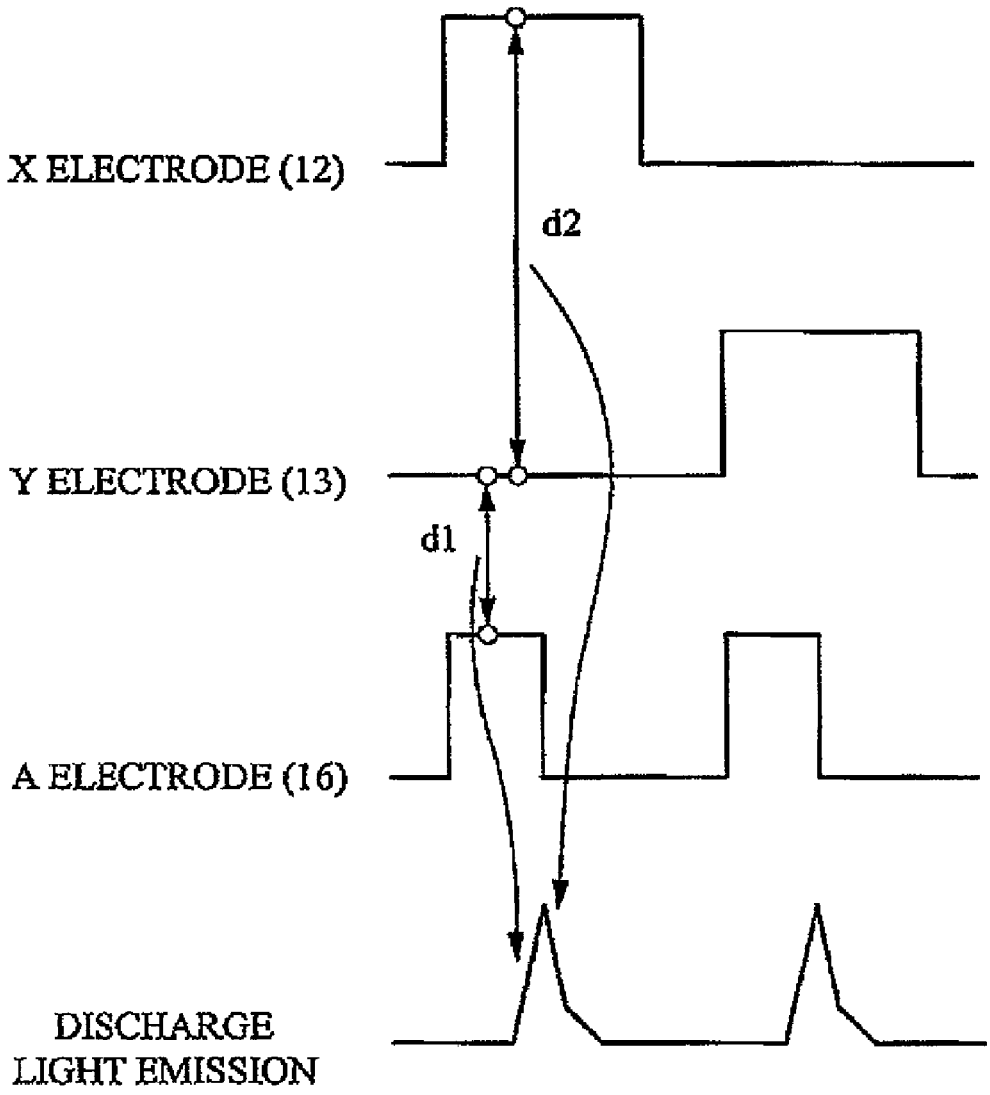
(Prior Art) FIG. 5
FIG. 5 is a view schematically showing driving waveforms of the display discharge in one example of the conventional plasma display apparatus.

As evident from a comparison between FIGS. 6 and 4, a display cell 10 of the plasma display apparatus according to the present embodiment is provided with a Z electrode 20 between an X electrode 12 and a Y electrode 13, unlike the conventional cell described with reference to FIG. 4. That is, the cell 10 is configured so as to include four electrodes, i.e., the X electrode 12, the Z electrode 20, and the Y electrode 13 provided on a front-side substrate 11 and an A electrode 16 provided on a rear-side substrate 15. Note that, as with the conventional cell shown in FIG. 4, a discharge gas such as a mixture of gases of neon and xenon is enclosed in a spacing 19 between the front-side substrate 11 and the rear-side substrate 15.

Also, as shown in FIG. 7, a potential of the Z electrode (central Z electrode) 20 is varied during a display discharge within a display period (sustain discharge period TS) so that a potential Vds at a discharge starting time Pds is made different from that a potential Vde at a discharge ending time Pde.

That is, as shown in FIG. 7, for example, when the display discharge is executed by raising the X electrode 12 to +Vs and lowering the Y electrode 13 to −Vs, a potential of the Z electrode 20 is lowered to −Vs in synchronization with the raising of the X electrode potential (the lowering of the Y−electrode potential). By doing so, an auxiliary discharge D1 serving as a trigger of a main discharge is generated between the X and Z electrodes having a short interelectrode distance.

Furthermore, after a predetermined time has elapsed from the raising of the X−electrode potential, the potential of the Z electrode 20 at a voltage of −Vs is inverted to +Vs. Therefore, a micro discharge D2 between the Y and Z electrodes and a main discharge D3 between the X and Y electrodes D3 occur, respectively. In this case, the main discharge (display discharge) D3 between the X and Y electrodes is executed immediately after the auxiliary discharge D1 between X and Z electrodes (micro discharge D2 between Y and Z electrodes), so that the luminance and the light-emitting efficiency at the display discharge can be improved.

Due to this, even when a distance between the X electrode 12 and the Y electrode 13 is set long (for example, equal to or longer than 200 to 250 μm), the display discharge can be executed in a state of the conventional display voltage (sustain discharge voltage) Vs. Thus, an effect of high light-emitting efficiency by a long-distance discharge (display discharge when the distance between the X and Y electrodes is set equal to or longer than 200 to 250 μm) can be obtained.

Also, according to the present embodiment, the auxiliary discharge D1 (micro discharge D2) occurs between the X and Z electrodes (Y and Z electrodes) between which the phosphor layer 18 does not exist, so that the characteristic deterioration of the phosphor material can be suppressed.

Note that when the voltages applied to the X electrode 12 and the Y electrode 13 have opposite polarities (when the X electrode 12 falls to a voltage of −Vs and the Y electrode 13 rises to a voltage of +Vs), a voltage having a polarity opposite to the voltage described above is applied to the Z electrode 20, so that the same discharge light emission occurs.

Figure 8A:
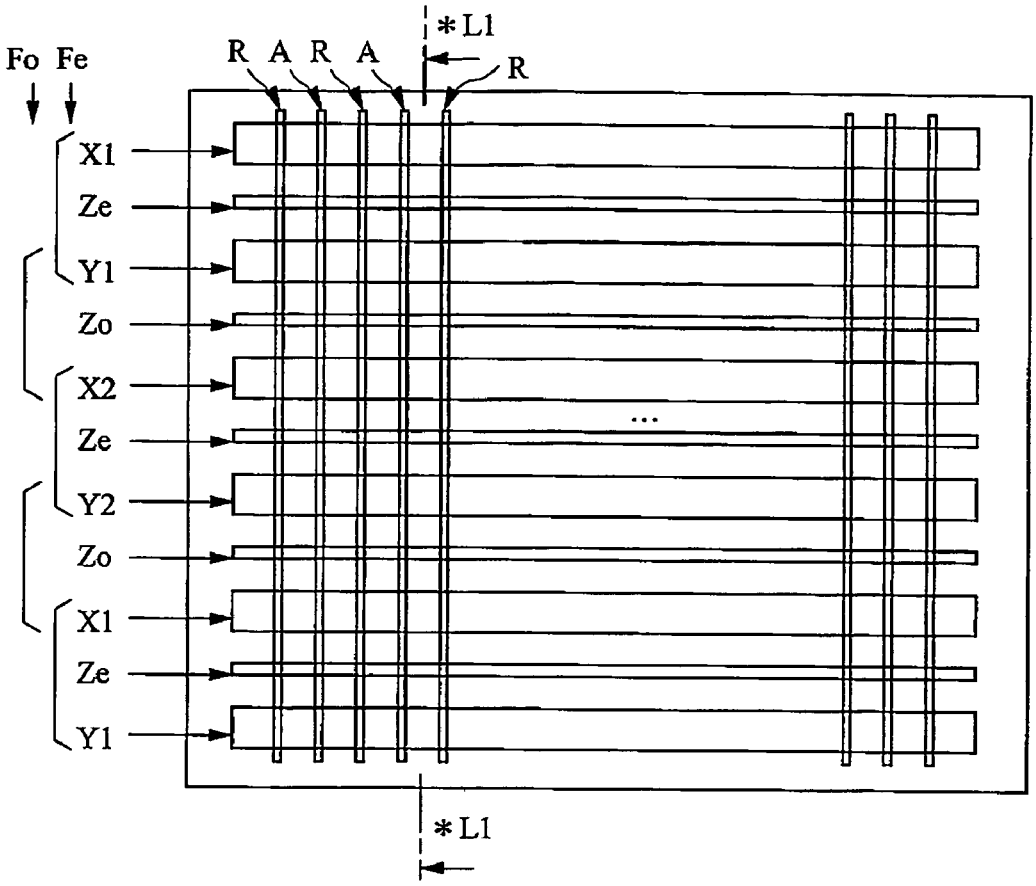
FIG. 8A is a view schematically showing an entire electrode structure of a display panel in the plasma display apparatus according to one embodiment of the present invention.
Figure 8B:
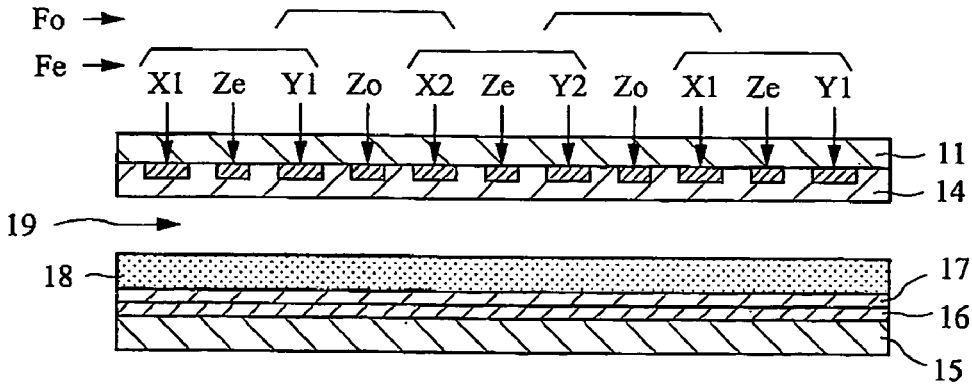
FIG. 8B is a view schematically showing an entire electrode structure of a display panel in the plasma display apparatus according to one embodiment of the present invention.

FIGS. 8A and 8B are views schematically showing an entire electrode structure of a display panel in the plasma display apparatus according to one embodiment of the present invention, and show a four-electrode ALIS (Alternate Lighting of Surfaces) structure. Here, FIG. 8A is a plan view of the panel and FIG. 8B is a sectional view taken along L1-L1 line in FIG. 8A. Note that in FIG. 8A, the reference numeral "R" denotes a barrier rib (rib).

As shown in FIG. 8B, electrodes X1, Ze, Y1, Zo, X2, Ze, Y2, Zo, X1, Ze, and Y1 (X electrodes 12, Y electrodes 13, and Z electrodes 20) and a dielectric layer 14 are formed on the front-side substrate 11, while the reference numerals "A" and "R" (A electrodes 16 and barrier ribs R), a dielectric layer 17, and a phosphor layer 18 are formed on the rear-side substrate 15.

In ALIS driving, positions of display cells to be turned ON are varied between even-numbered frames Fe and odd-numbered frames Fo, and a combination of electrodes used in the display is varied. Specifically, as shown in FIGS. 8A and 8B, in the even-numbered frame Fe, the display electrodes X1, Ze, Y1, and A form one set, and the display electrodes X2, Ze, Y2, and A form another set. At this time, the electrodes Zo are not used as display electrodes, but are used as, for example, barrier electrodes fixed to the ground potential (0 V) to suppress interference between the display cells.

Also, in the odd-numbered frame Fo, the display electrodes Y1, Zo, X2, and A form one set, while the display electrodes Y2, Zo, X1, and A form another set. At this time, the electrodes Ze are not used as display electrodes, but are used as, for example, barrier electrodes fixed to the ground potential to suppress interference between the display cells.

In this case, a member for suppressing the interference between the display cells by providing the barrier electrodes is not limited to the panel having the four-electrode ALIS structure shown in FIGS. 8A and 8B. As a matter of course, the same effects can also be obtained by, for example, a panel having a straight rib structure in which the barrier ribs R are provided only in a direction parallel to the A electrodes.

Furthermore, the display electrode Ze in the even-numbered frame Fe and the display electrode Zo in the odd-numbered frame Fo serve as the Z electrodes 20 described with reference to FIGS. 6 and 7 and their potential is varied during the display discharge so that the potential at the discharge start time Pds is different from the potential at the discharge end time Pde, thereby improving the luminance and the light-emitting efficiency in the display discharge.

Figure 9:
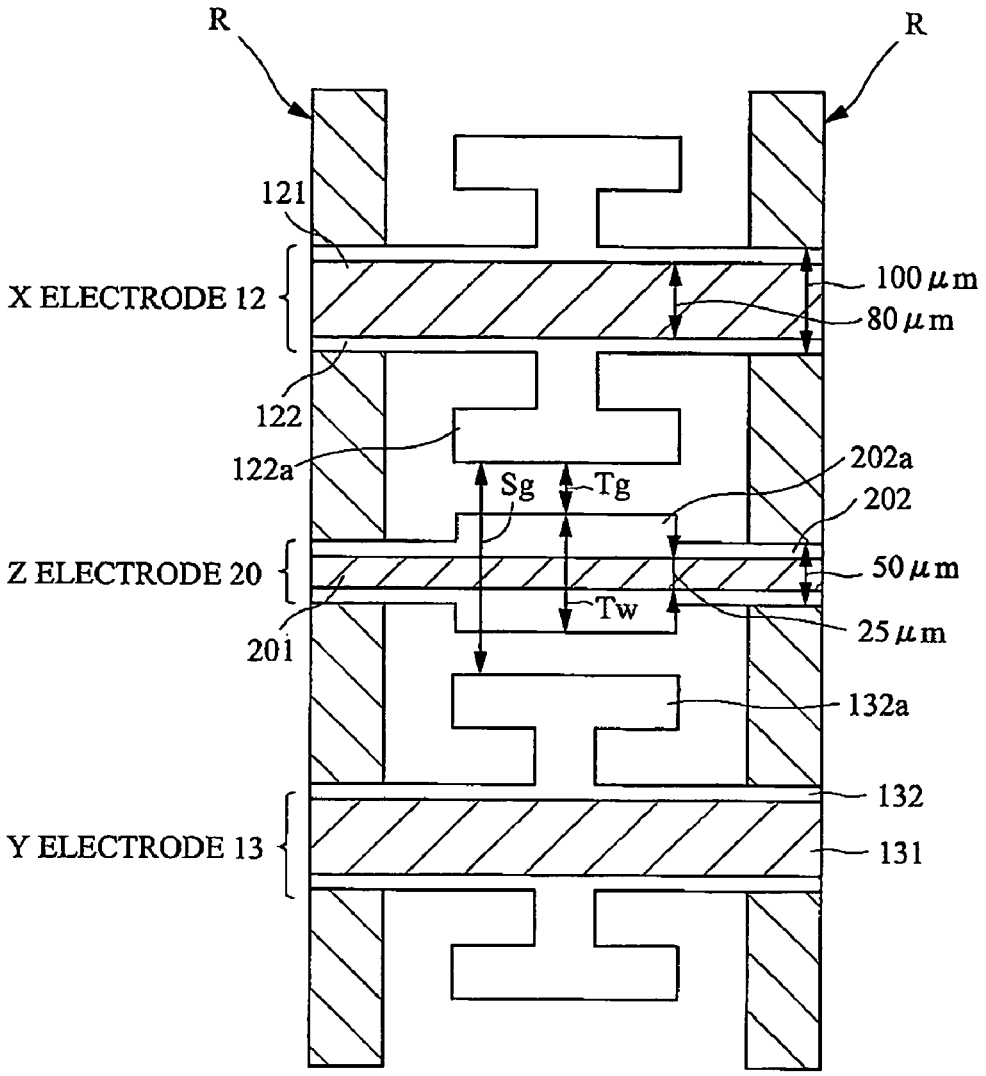
FIG. 9 is a view for explaining one example of an electrode structure of one cell of the plasma display apparatus according to one embodiment of the present invention.

FIG. 9 is a view for explaining an electrode structure of one cell of the plasma display apparatus according to one embodiment of the present invention, and shows the electrode structure having being actually used for an experiment. Note that the experiment was conducted fixedly on the even-numbered frame (Fe). Also, FIGS. 10 and 11 are views schematically showing driving waveforms of the display discharge in the plasma display apparatus according to one embodiment of the present invention.

As shown in FIG. 9, the X electrode 12 is formed by a bus electrode 121 made of metal (Cr/Cu/Cr) and a transparent electrode (ITO) 122 having T-shaped portions 122*a* at whose tips the discharges are executed. Also, the Y electrode 13 is formed by a bus electrode 131 made of metal and a transparent electrode 132 having T-shaped portions 132*a* at whose tips the discharges are executed. Furthermore, the Z electrode 20 is formed by a bus electrode 201 made of metal and a transparent electrode 202 having corresponding shape portions 202*a* whose tips to be discharged correspond to the T-shaped portions of the X and Y electrodes.

Also, the width of the bus electrodes 121 and 131 of the X and Y electrodes is set at 80 μm; the width of the transparent electrodes 122 and 132 of the X and Y electrodes except the T-shaped portions is set at 100 μm; the width of the bus electrode 201 of the Z electrode is set at 25 μm; the width of the transparent electrode 202 of the Z electrode except the corresponding shape portions to the T-shaped portions is set at 50 μm; and width Tw of the corresponding shape portion 202*a* to the T-shaped portions in the transparent electrode 202 of the Z electrode is set at 50 μm. Furthermore, a distance (gap) Tg between the X and Y electrodes (T-shaped portions 122*a* and 132*a* of the transparent electrodes) and the Z electrode (corresponding shape portions 202*a* to the T-shaped portions of the transparent electrodes) is set at 250 μm.

Figure 10:
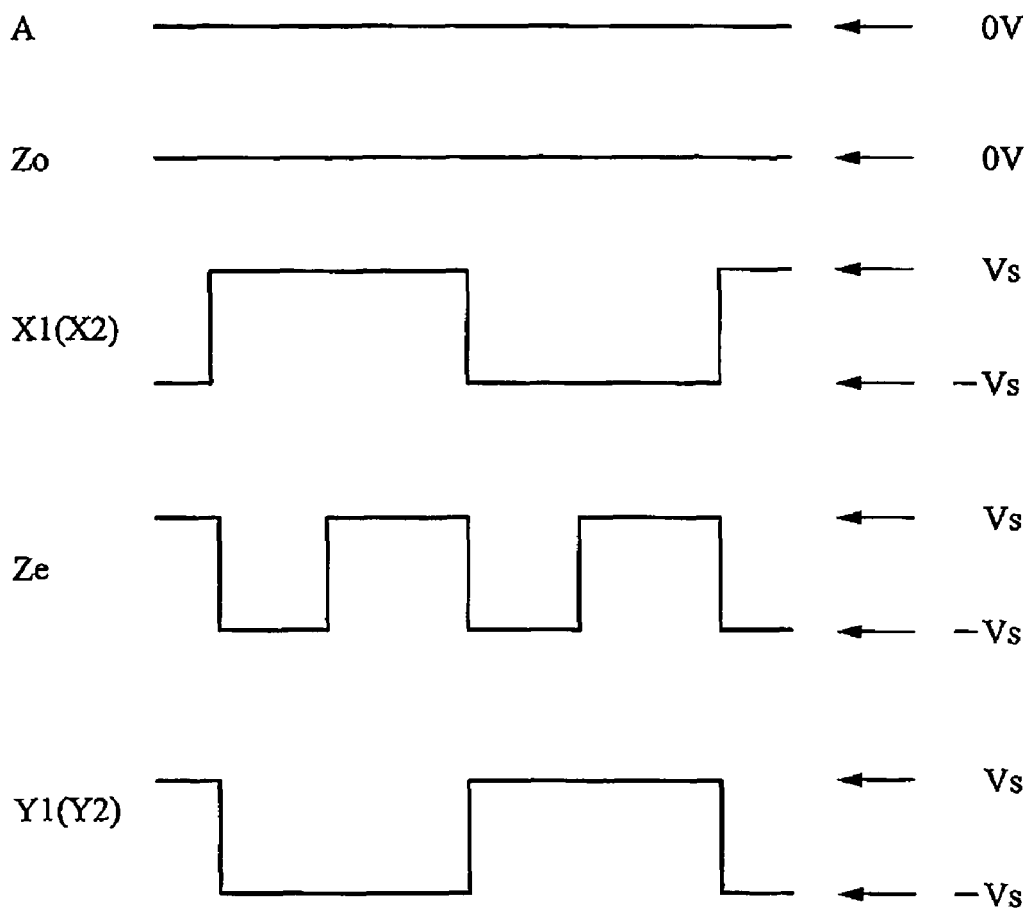
FIG. 10 is a first view schematically showing driving waveforms of the display discharge in the plasma display apparatus according to one embodiment of the present invention.
Figure 11:
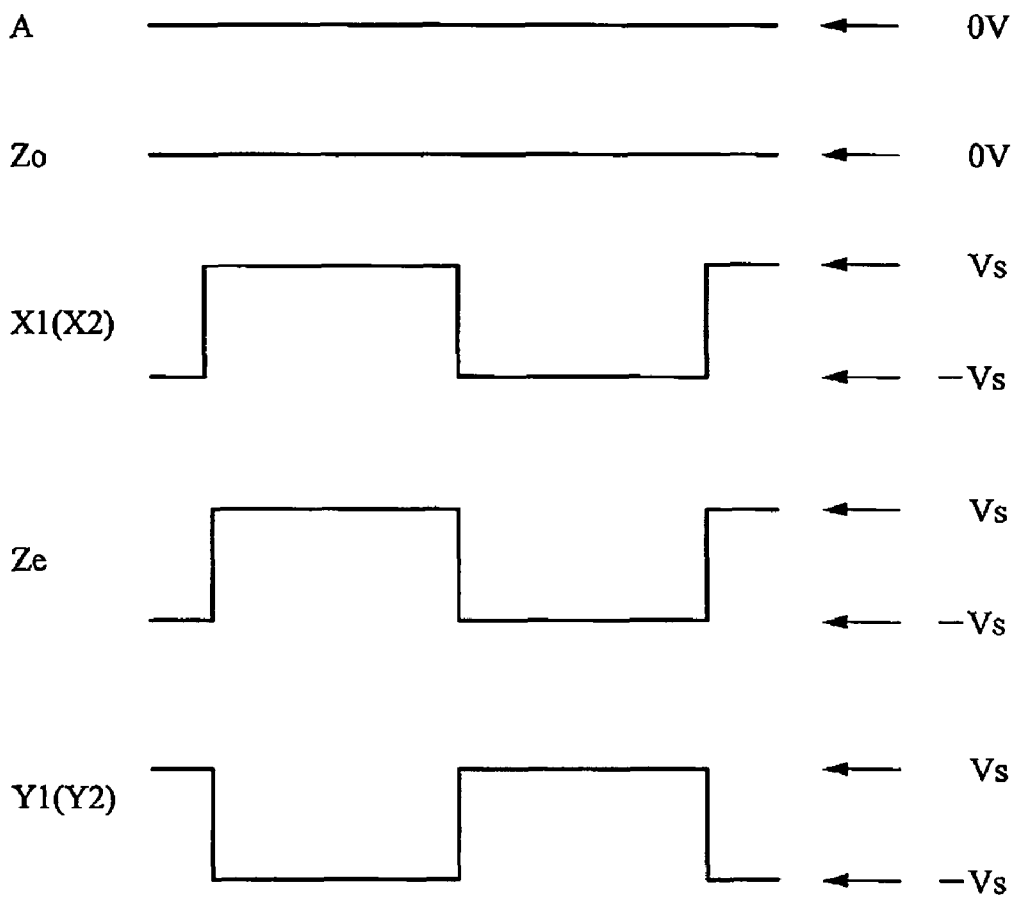
FIG. 11 is a second view schematically showing driving waveforms of display discharge in the plasma display apparatus according to one embodiment of the present invention.

When the panel was driven by applying the driving waveforms shown in FIG. 10 (equivalent to the above-described driving waveforms in FIG. 7) to this discharge cell shown in FIG. 9 and by setting the display voltage (sustain discharge voltage) Vs at 85 V, the light-emitting efficiency was 1.45 lm/W. Note that when the panel was driven by applying, to the discharge cell shown in FIG. 9, the driving waveforms shown in FIG. 11 in which the potential of the Z electrode (Ze) does not vary during the discharge and by setting the display voltage Vs at 85 V, the light-emitting efficiency was 1.20 lm/W.

Thus, when the potential of the Z electrode as shown in FIG. 10 (FIG. 7) is varied during the display discharge within the display period and the potential at the discharge start time (Pds) is different from that at the discharge end time (Pde), it is understood that the light-emitting efficiency is sufficiently larger than the light-emitting efficiency obtained when the potential of the Z electrode is not varied during the discharge. Also, since the Z electrode 20 is formed on the front-side substrate (11) on which the X electrode 12 and the Y electrode 13 are also provided, the characteristic deterioration in the phosphor layer (18) provided on the rear-side substrate (15) hardly occurs by the discharges (auxiliary discharges) between the X and Z electrodes and between the Y and Z electrodes.

Figure 12:
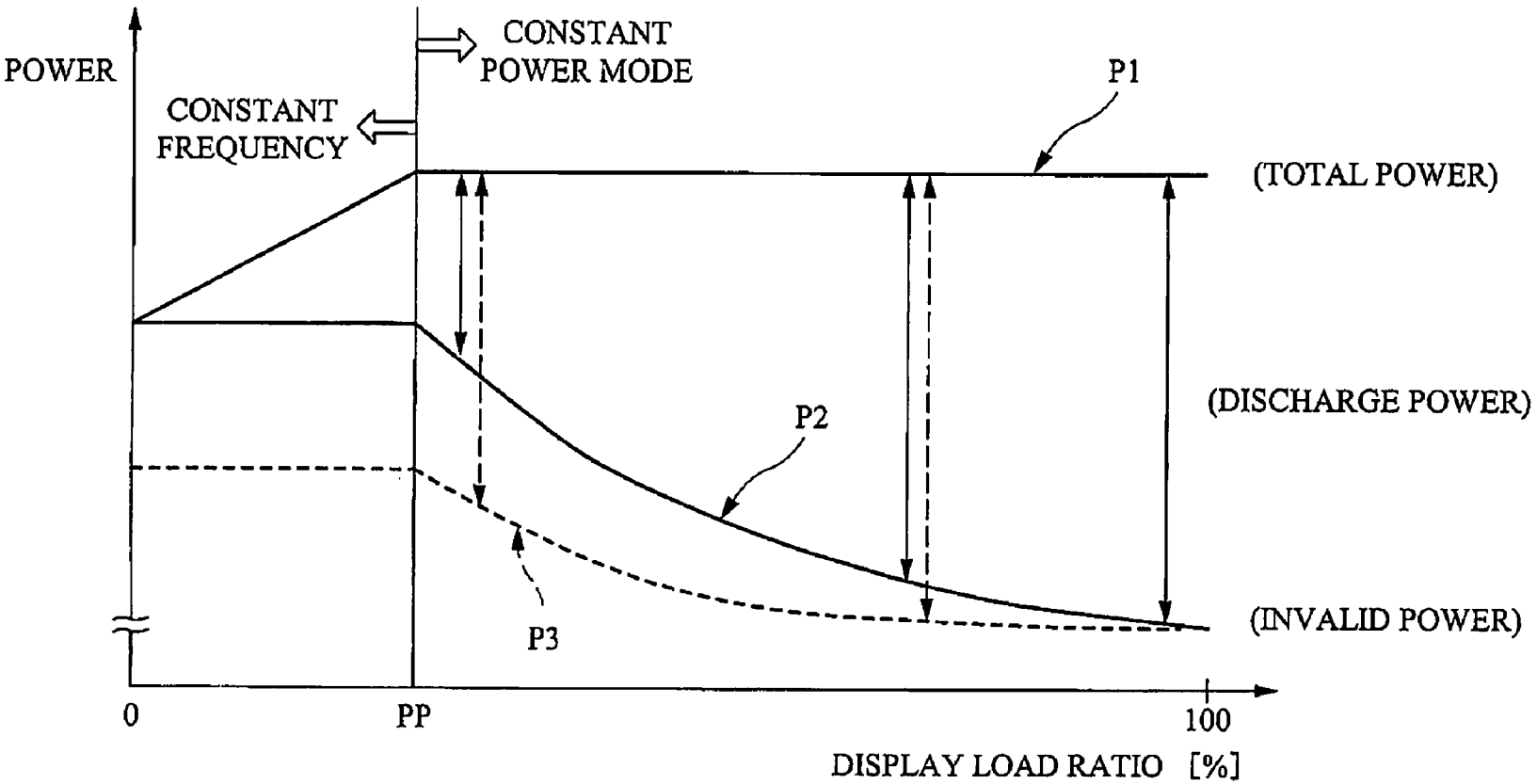
FIG. 12 is a first view for explaining a switching of driving waveforms of a display discharge in a plasma display apparatus according to another embodiment of the present invention.

FIGS. 12 and 13A to 13D are views for explaining a switching of driving waveforms of a display discharge in a plasma display apparatus according to another embodiment of the present invention. FIG. 12 is a view conceptually showing a relation between a display load ratio and power, whilst FIGS. 13A to 13D are views for explaining the switching of the driving waveforms.

In FIG. 12, a curve P1 represents the total power consumed on the panel, a curve P2 represents invalid power (charge/discharge power) when the above-described driving waveforms of FIG. 10 are applied, and a curve P3 represents invalid power when the above-described driving waveforms of FIG. 11 are applied. In this case, the discharge power is obtained by subtracting the invalid power (P2 and P3) from the total power (P1).

In the plasma display panel, an upper limit is set on power consumption, so that automatic power control (APC) is carried out to lower sequentially the frequency of the display discharge and make the power consumption constant when the display load ratio exceeds a predetermined value (PP).

However, the power consumed on the panel is classified into invalid power consumed during the charge/discharge of an interelectrode capacitance of the panel and discharge power consumed for discharge light emission. As the display load ratio is lower and the frequency of the display discharge is higher, the charge/discharge current in the panel becomes larger, so that the invalid power becomes larger and the discharge power used for the discharge light emission becomes smaller. Conversely, as the display load ratio is higher and the frequency of the display discharge is lower, the charge/discharge current in the panel is smaller, so that the invalid power becomes smaller and the discharge power used for the discharge light emission becomes larger.

On the other hand, when the panel is driven by the driving waveforms in which the potential of the Z electrode is varied during the display discharge (driving waveforms of FIG. 10), the power consumed for the discharge light emission can be suppressed to be low (the light-emitting efficiency can be increased). However, since the number of times of changes in the interelectrode voltage is large, as shown by the curve P2 in FIG. 12, the charge/discharge power of the interelectrode capacitance of the panel becomes large. Conversely, when the panel is driven by the driving waveforms in which the potential of the Z electrode is not varied during the display discharge (the driving waveforms of FIG. 11), the power consumed for the discharge light emission is large (the light-emitting efficiency is low). However, the same waveforms are applied to two electrodes (the X and Z electrodes in the case of the even-numbered frame of FIG. 11), so that the charge/discharge power of the interelectrode capacitance of the panel becomes small.

Figures 13A, 13B, 13C, 13D:
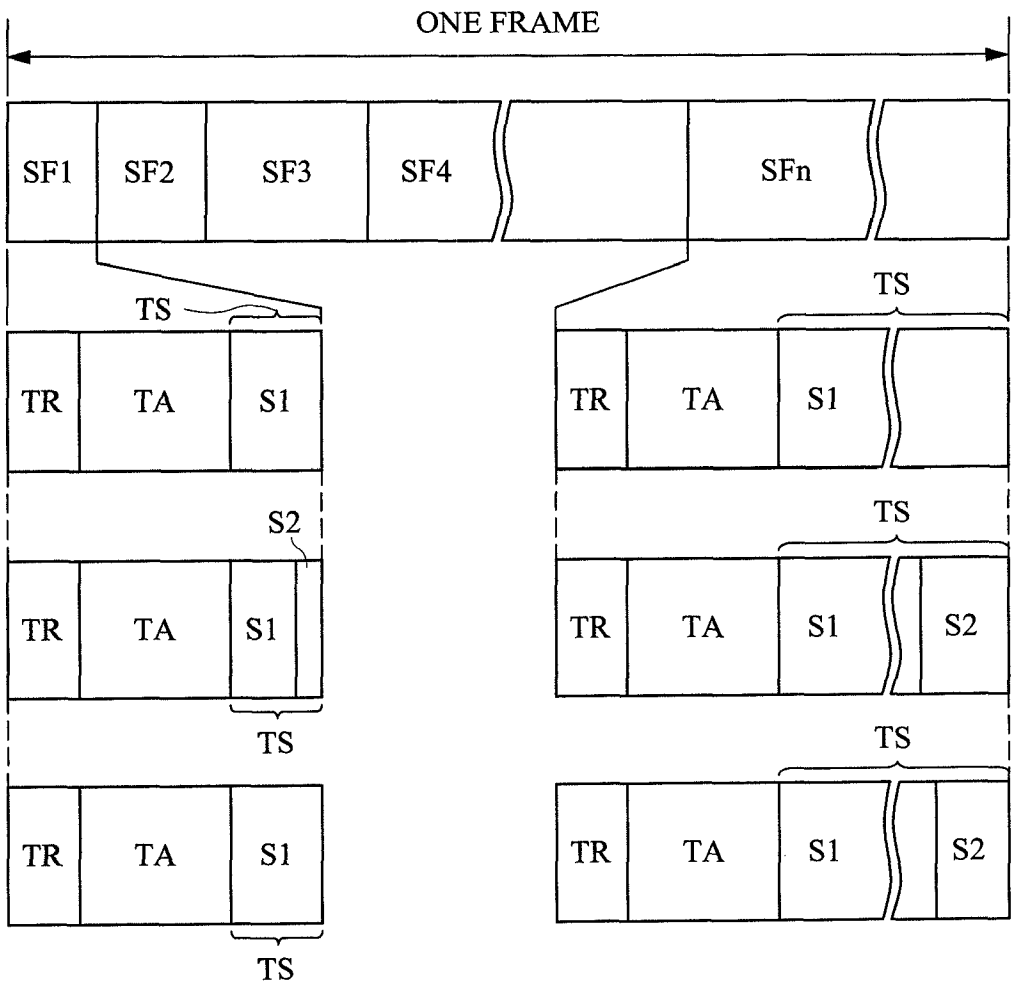
FIG. 13A is a second view for explaining the switching of the driving waveforms of the display discharge in a plasma display apparatus according to another embodiment of the present invention.
FIG. 13B is a second view for explaining the switching of the driving waveforms of the display discharge in a plasma display apparatus according to another embodiment of the present invention.
FIG. 13C is a second view for explaining the switching of the driving waveforms of the display discharge in a plasma display apparatus according to another embodiment of the present invention.
FIG. 13D is a second view for explaining the switching of the driving waveforms of the display discharge in a plasma display apparatus according to another embodiment of the present invention.

FIG. 13A is a view showing a sub-frame structure. FIGS. 13B to 13D show changes in a period S1 of using first driving waveforms (driving waveforms of FIG. 10) and in a period S2 of using second driving waveforms (driving waveforms of FIG. 11) within the display periods (sustain discharge periods) TS of the sub-frames SF1 and SFn.

As shown in FIGS. 13B to 13D, the display period TS of each sub-frame is formed by the period S1 in which the first driving waveforms are used and the period S2 in which the second driving waveforms are used. A ratio of the period S2 is controlled so as to be varied from 0% to 100%.

FIG. 13B shows a state where only the first driving waveforms (S1) are used in all the sub-frames; FIG. 13C shows a state where both of the first driving waveforms (S1) and the second driving waveforms (S2) are used in all the sub-frames; and FIG. 13D shows a state where both of the first driving waveforms (S1) and the second driving waveforms (S2) are used in a portion of any sub-frames including the sub-frame SFn and only the first driving waveforms (S1) are used in other sub-frames including the sub-frame SF1. Note that the sub-frames in which only the first driving waveforms (S1) are used may not necessarily include the sub-frame SF1 and further only the second driving waveforms (S2) may be used in all the sub-frames although not shown.

In the present embodiment, when the display load ratio is small, the display discharge is executed so that the ratio of the driving waveforms for varying the potential of the Z electrode (represented by the curve P2 in FIG. 12 and the period S1 in FIG. 13) is decreased and the ratio of the driving waveforms for varying no potential of the Z electrode (represented by the curve P3 in FIG. 12 and the period S2 in FIG. 13) is increased. Conversely, when the display load ratio is large, the display discharge is executed so that the ratio of the driving waveforms for varying the potential of the Z electrode (P2 and S1) is increased and the ratio of the driving waveforms for varying no potential of the Z electrode (P3 and S2) is decreased.

Figure 14:
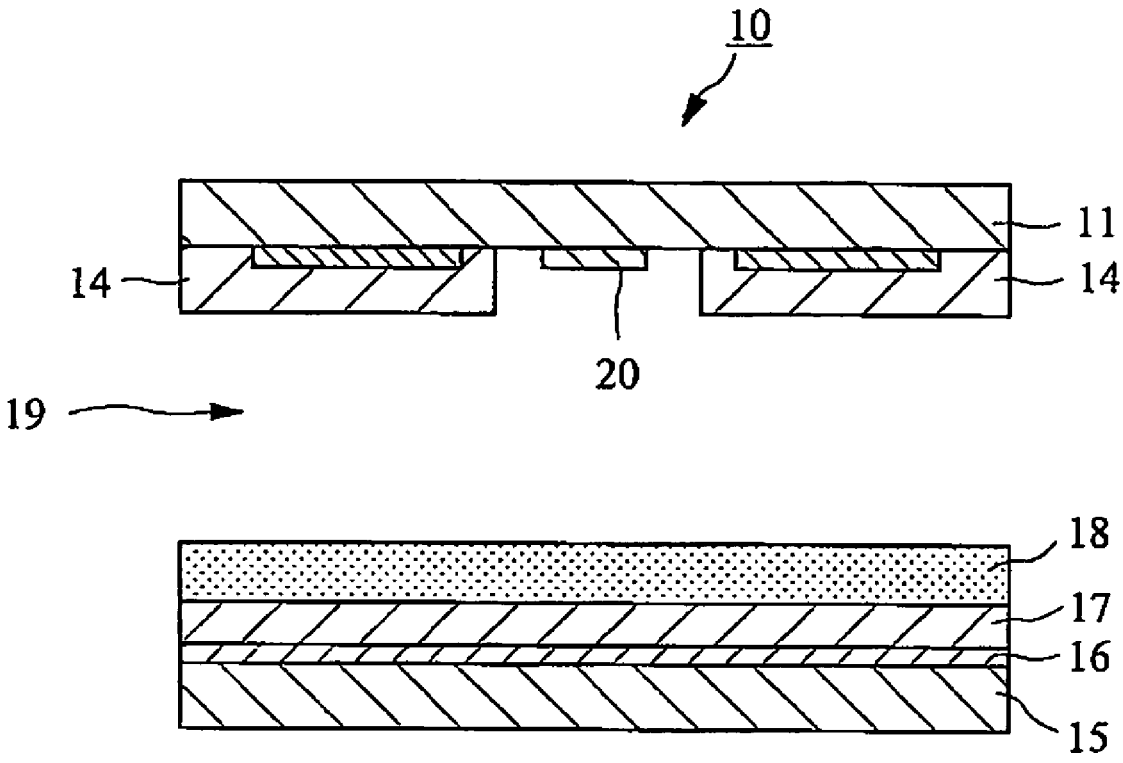
FIG. 14 is a first view schematically showing a modification example of the electrode structure of one cell of the plasma display apparatus according to another embodiment of the present invention.
Figure 15:
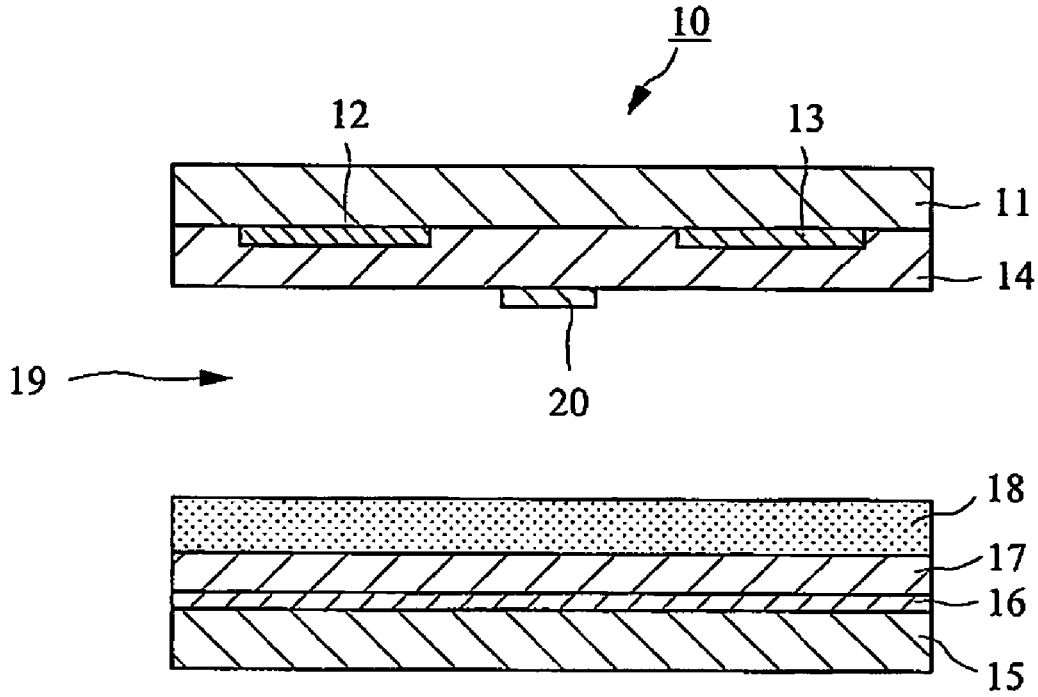
FIG. 15 is a second view schematically showing a modification example of the electrode structure of one cell of the plasma display apparatus according to the other embodiment of the present invention.

FIGS. 14 and 15 are views schematically showing modification examples of the electrode structure in one cell of the plasma display apparatus according to one embodiment of the present invention.

In the modification examples shown in FIGS. 14 and 15, the Z electrode 20 is exposed to the discharge space 19. That is, in the modification example shown in FIG. 14, no dielectric layer is provided on the Z electrode 20 and the Z electrode 20 is exposed to the discharge space 19, whereby the discharges between the X and Z electrodes and the Y and Z electrodes are executed at lower voltages. Also, in the modification example shown in FIG. 15, the Z electrode 20 is exposed to the discharge space 19 by forming the Z electrode 20 on the dielectric layer 14, whereby the discharges between the X and Z electrodes and the Y and Z electrodes are executed at lower voltages.

In the foregoing, the description has been made mainly by taking the plasma display panel having the ALIS structure as an example. However, the present invention can be widely applied not only to the plasma display panel having the ALIS structure but also to a plasma display apparatus including a plasma display panel having a straight rib structure or more generally to a plasma display apparatus having a structure in which at least three display electrodes used for the display discharge are provided for each display cell and no phosphor layer is formed between the display electrodes and the discharge space.

The present invention can be applied to the plasma display panel having the straight rib structure, including a plasma display panel having the ALIS structure and, furthermore, can be widely applied to a plasma display apparatus including a plasma display panel having a structure in which at least three display electrodes for the display discharge are provided for each display cell and no phosphor layer is formed between the display electrodes and the discharge space. Note that the plasma display apparatus can be used as a display apparatus for a personal computer and a work station, a flat-type wall-mounted television, and an apparatus for displaying advertisements, information, and others.

(Note 1) A method of driving a plasma display panel having a structure, in which at least three display electrodes used for a display discharge are provided to a display cell and no phosphor layer is formed between said display electrodes and a discharge space, comprises the steps of:

varying a potential of at least one display electrode of said display electrodes during said display discharge; and making a potential of said at least one display electrode at a time of starting said display discharge different from that at a time of ending said display discharge.

(Note 2) In the method of driving a plasma display panel according to note 1, said phosphor layer is provided in a first substrate and said display electrodes are provided in a second substrate opposite to said first substrate.

(Note 3) In the method of driving a plasma display panel according to note 2, said display electrodes are such that three display electrodes are provided to said display cell.

(Note 4) In the method of driving a plasma display panel according to note 3, each of said three display electrodes is provided in parallel with said second substrate.

(Note 5) In the method of driving a plasma display panel according to note 4, a potential of a central display electrode among said three display electrodes at the time of starting said display discharge is made different from that at the time of ending said display discharge.

(Note 6) In the method of driving a plasma display panel according to note 2, an address electrode for executing an address discharge with any of said display electrodes is provided on said first substrate.

(Note 7) In the method of driving a plasma display panel according to note 1, said display cell is such that the discharge space is partitioned by a barrier electrode provided between display cells adjacent to each other in a direction approximately perpendicular to a direction in which said display electrodes extend.

(Note 8) In the method of driving a plasma display panel according to note 7, said plasma display panel has an ALIS structure, in an even-numbered frame, a set of three successive three electrodes provided as a cell of said even-numbered frame are used as said display electrodes, a potential of a central electrode among said set of three display electrodes at the time of starting said display discharge is made different from that at the time of ending said display discharge, and an electrode between the cells adjacent in said even-numbered frame is used as a barrier electrode of said even-numbered frame, and in an odd-numbered frame, a set of three successive electrodes in which the barrier electrode in the even-numbered frame provided as the cell of the odd-numbered frame is set as a central electrode are used as said display electrodes, a potential of the central electrode among said set of three display electrodes at the time of starting said display discharge is made different from that at the time of ending said display discharge, and the central electrode of said even-numbered frame is used as the barrier electrode of said odd-numbered frame.

(Note 9) In the method of driving a plasma display panel according to note 8, said barrier electrode is fixed to a predetermined potential during said display discharge.

(Note 10) In the method of driving a plasma display panel according to note 1, the plasma display panel is provided with: a first driving waveform making a potential of at least one display electrode among said display electrodes at the time of starting said display discharge different from that at the time of ending said display discharge; and a second driving waveform making no potential of the at least one display electrode among said display electrodes varied during said display discharge, and the panel is driven so that, when a display load ratio of said plasma display panel is small, a ratio of said first driving waveform is decreased to increase a ratio of said second driving waveform and as the display load ratio of said plasma display panel is increased, the ratio of said first driving Waveform is increased to decrease the ratio of said second driving waveform.

(Note 11) In the method of driving a plasma display panel according to note 1, no dielectric layer is provided on said at least one display electrode, and said at least one display electrode is exposed to the discharge space.

(Note 12) A plasma display apparatus comprises:

a plasma display panel having a plurality of X electrodes, a plurality of Y electrodes disposed approximately in parallel with said plurality of X electrodes and discharged between the plurality of Y electrodes and said plurality of X electrodes, and a plurality of Z electrodes each provided between each of said X electrodes and each of said Y electrodes;

a driver for driving said plasma display panel; and a control circuit for receiving an image signal, converting the image signal to image data suitable for said plasma display panel and for driving said plasma display panel through said driver, wherein a cell is formed by said X electrode, said Y electrode, and a central Z electrode located between said X electrode and said Y electrode, a potential of said central Z electrode is varied during a display discharge so that the potential of said central Z electrode at a time of starting said display discharge is made different from that at a time of ending said display discharge.

(Note 13) In the plasma display apparatus according to note 12, said X electrodes, said Y electrodes, and said Z electrodes are formed in a first substrate, and an A electrode and a phosphor layer for executing an address discharge with any one of said X electrodes, said Y electrodes, and said Z electrodes are formed in a second substrate opposite to said first substrate.

(Note 14) In the plasma display apparatus according to note 12, said plasma display panel is a panel having a straight rib structure, and said Z electrode between adjacent cells in a direction perpendicular to said X electrodes, said Y electrodes, and said Z electrodes is used as a barrier Z electrode for partitioning a discharge space between said adjacent cells.

(Note 15) In the plasma display apparatus according to note 14, said plasma display panel is a panel having an ALIS structure, in an even-numbered frame, a potential of said central Z electrode in the cell of said even-numbered frame at the time of starting said display discharge is made different from that at the time of ending said display discharge, and said Z electrode located between the cells adjacent in said even-numbered frame is used as a barrier electrode of said even-numbered frame, and in an odd-numbered frame, the potential of said central Z electrode in the cell of said odd-numbered frame at the time of starting said display discharge is made different from that at the time of ending said display discharge, and said central Z electrode of said even-numbered frame is used as a barrier electrode of said odd-numbered frame.

(Note 16) In the plasma display apparatus according to note 15, said barrier electrode is fixed to a predetermined potential during said display discharge.

(Note 17) In the plasma display apparatus according to note 12, the plasma display panel is provided with: a first driving waveform making a potential of said central Z electrode at the time of starting said display discharge different from that at the time of ending said display discharge; and a second driving waveform making no potential of said central Z electrode varied during said display discharge, and the panel is driven so that, when a display load ratio of said plasma display panel is small, a ratio of said first driving waveform is decreased to increase a ratio of said second driving waveform and as the display load ratio of said plasma display panel is increased, the ratio of said first driving waveform is increased to decrease the ratio of said second driving waveform.

(Note 18) In the plasma display apparatus according to note 12, no dielectric layer is provided on said Z electrodes, and said Z electrodes are exposed to a discharge space.

(Note 19) A plasma display apparatus comprises:

a plasma display panel having a structure in which at least three display electrodes used for a display discharge are provided to a display cell and no phosphor layer is formed between said display electrodes and a discharge space;

a driver for driving said plasma display panel; and a control circuit for receiving an image signal, converting the image signal to image data suitable for said plasma display panel and for driving said plasma display panel through said driver, wherein the method of driving a plasma display panel according to any one of the claims is applied to the plasma display panel.

What is claimed is:

1. A method of driving a plasma display panel having a structure in which an X electrode, a Y electrode, and a Z electrode provided between said X electrode and said Y electrode are provided and no phosphor layer is formed between said X electrode, Y electrode, and Z electrode and a discharge space, the method comprising the steps of:

making one repeated period of a driving waveform applied to said Z electrode a half of one repeated period of a driving waveform applied to said X and Y electrodes;

varying, after an occurrence of an auxiliary discharge within a display discharge between said X electrode, Y electrode, and Z electrode, a potential of said Z electrode from a first potential to a second potential;

after the potential variation, causing a main discharge within the display discharge, which has a discharge intensity larger than that of said auxiliary discharge within the display discharge to occur; and sustaining the potential of said Z electrode at said second potential until at least said main discharge within said display discharge ends.

2. A method of driving a plasma display panel having a structure in which an X electrode, a Y electrode, and a Z electrode provided between said X electrode and said Y electrode are provided, and no phosphor layer is formed between said X electrode, Y electrode, and Z electrode and a discharge space, wherein the plasma display panel is provided with:

a first driving waveform driven so as to:

make one repeated period of a driving waveform applied to said Z electrode a half of one repeated period of a driving waveform applied to said X and Y electrodes;

vary, after an occurrence of an auxiliary discharge within a display discharge between said X electrode, Y electrode, and Z electrode, a potential of said Z electrode from a first potential to a second potential;

after the potential variation, cause a main discharge within the display discharge, which has a discharge intensity larger than that of said auxiliary discharge within the display discharge, to occur; and sustain the potential of said Z electrode at said second potential until at least said main discharge within said display discharge ends; and a second driving waveform making one repeated period of a driving waveform applied to said Z electrode equal to one repeated period of a driving waveform applied to said X and Y electrodes, and fixing the potential of said Z electrode from a starting time of said display discharge to an ending time thereof, and wherein, the panel is driven so that, when a display load ratio of said plasma display panel is small, a ratio of a time of applying repeatedly said first driving waveform is decreased to increase a ratio of a time of applying repeatedly second driving waveform and as the display load ratio of said plasma display panel is increased, the ratio of the time of applying repeatedly said first driving waveform is increased to decrease the ratio of the time of applying repeatedly said second driving waveform.

3. A plasma display apparatus comprising:

a plasma display panel having a plurality of X electrodes, a plurality of Y electrodes, and a plurality of Z electrodes each provided between each of said X electrodes and each of said Y electrodes;

a driver for driving said plasma display panel; and a control circuit for receiving an image signal, converting the image signal to image data suitable for said plasma display panel, and driving said plasma display panel through said driver, wherein said control circuit is controlled to:

make one repeated period of a driving waveform applied to said Z electrode a half of one repeated period of a driving waveform applied to said X and Y electrodes;

vary, after an occurrence of an auxiliary discharge within a display discharge between said X electrode, Y electrode, and Z electrode, the potential of said Z electrode from a first potential to a second potential, and after the potential variation, cause a main discharge within said display discharge, which has a discharge intensity larger than that of said first display discharge, to occur; and sustain the potential of said Z electrode at said second potential until at least said main discharge within said display discharge ends.

* * * * *